US007160840B2

(12) United States Patent
Iwasaki et al.

(10) Patent No.: US 7,160,840 B2
(45) **Date of Patent: *Jan. 9, 2007**

(54) THERMAL RECORDING MATERIAL

(75) Inventors: Masayuki Iwasaki, Shizuoka (JP); Tsutomu Watanabe, Shizuoka (JP); Hirofumi Mitsuo, Shizuoka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/481,958

(22) PCT Filed: May 31, 2002

(86) PCT No.: PCT/JP02/05347

§ 371 (c)(1),
(2), (4) Date: Dec. 24, 2003

(87) PCT Pub. No.: WO03/002354

PCT Pub. Date: Sep. 9, 2003

(65) Prior Publication Data

US 2004/0235660 A1 Nov. 25, 2004

(30) Foreign Application Priority Data

Jun. 28, 2001 (JP) ..... 2001-197200
Jul. 2, 2001 (JP) ..... 2001-201202
Aug. 24, 2001 (JP) ..... 2001-254209
Aug. 24, 2001 (JP) ..... 2001-254210

(51) Int. Cl.
*B41M 5/30* (2006.01)

(52) U.S. Cl. ..... 503/216; 503/200; 503/217; 503/221

(58) Field of Classification Search ..... 503/200–226
See application file for complete search history.

(56) References Cited

U.S. PATENT DOCUMENTS

| | | | | |
|---|---|---|---|---|
| 3,897,998 | A | 8/1975 | Someya et al. | |
| 4,414,259 | A | 11/1983 | Tsuchiya et al. | |
| 4,585,483 | A * | 4/1986 | Ikeda et al. | 503/216 |
| 5,068,133 | A | 11/1991 | Matsumoto et al. | |
| 5,071,821 | A | 12/1991 | Smith et al. | |
| 5,112,798 | A | 5/1992 | Miyauchi | |
| 5,721,190 | A | 2/1998 | Miyamoto et al. | |
| 5,847,744 | A | 12/1998 | Hoki et al. | |
| 6,410,479 | B1 * | 6/2002 | Fukuchi et al. | 503/226 |
| 6,497,926 | B1 | 12/2002 | Yokota et al. | |
| 6,596,358 | B1 * | 7/2003 | Sakamoto et al. | 428/40.1 |
| 6,642,175 | B1 | 11/2003 | Mitsuo et al. | |
| 6,699,816 | B1 | 3/2004 | Iwasaki et al. | |
| 6,818,592 | B1 | 11/2004 | Watanabe et al. | |
| 6,852,671 | B1 * | 2/2005 | Iwasaki et al. | 503/216 |
| 6,972,272 | B1 | 12/2005 | Iwasaki et al. | |
| 2004/0176247 | A1 | 9/2004 | Iwasaki et al. | |
| 2005/0054527 | A1 | 3/2005 | Iwasaki et al. | |
| 2005/0088508 | A1 | 4/2005 | Iwasaki et al. | |
| 2005/0170959 | A1 | 8/2005 | Iwasaki et al. | |

FOREIGN PATENT DOCUMENTS

| | | | |
|---|---|---|---|
| EP | 405363 | A2 | 1/1991 |
| EP | 0462770 | A1 | 12/1991 |
| EP | 0542556 | A1 | 5/1993 |
| EP | 0 631 876 | A2 | 1/1995 |
| EP | 0992363 | A1 | 4/2000 |
| EP | 1 060 904 | A2 | 12/2000 |
| JP | 49-24133 | A | 3/1974 |
| JP | 54-074761 | A | 6/1979 |
| JP | 56-017286 | A | 2/1981 |
| JP | 57-041995 | A | 3/1982 |
| JP | 57-212094 | A | 12/1982 |
| JP | 61-057387 | A | 3/1986 |
| JP | 10-35103 | A | 2/1989 |
| JP | 01-306282 | A | 12/1989 |
| JP | 2-020385 | | 1/1990 |
| JP | 2-169291 | A | 6/1990 |
| JP | 02-258292 | A | 10/1990 |
| JP | 02-301484 | A | 12/1990 |
| JP | 03-193485 | A | 8/1991 |
| JP | 3-290285 | A | 12/1991 |
| JP | 4-001085 | A | 1/1992 |
| JP | 4-105987 | A | 4/1992 |
| JP | 4-221681 | A | 8/1992 |
| JP | 4-325285 | A | 11/1992 |
| JP | 04-332682 | A | 11/1992 |
| JP | 5-032052 | A | 2/1993 |
| JP | 5-104062 | A | 4/1993 |
| JP | 05-201138 | A | 8/1993 |

(Continued)

OTHER PUBLICATIONS

Japanese Office Action, JP App. No. 2001-254210, Mar. 22, 2006.

(Continued)

*Primary Examiner*—Bruce H. Hess
(74) *Attorney, Agent, or Firm*—Sughrue Mion, PLLC

(57) ABSTRACT

A thermal recording material having a support and, formed thereon, a thermal coloring layer containing an electron donating colorless dye and an electron accepting compound, wherein the electron accepting compound comprises 4-hydroxybenzenesulfoneanilide and the support comprises a used paper pulp as a primary component; the thermal recording material which further comprises at least one of calcium carbonate of calcite type, amorphous silica and aluminum hydroxide as an inorganic pigment; and the thermal recording material wherein the electron donating colorless dye comprises a specific colorless dye and the recording material is formed through the use of a liquid pigment dispersion having a pH of 7 to 10.

5 Claims, No Drawings

FOREIGN PATENT DOCUMENTS

| | | | |
|---|---|---|---|
| JP | 05-330239 | A | 12/1993 |
| JP | 6-72051 | A | 3/1994 |
| JP | 4-110188 | A | 4/1994 |
| JP | 6-183158 | A | 5/1994 |
| JP | 6-179290 | A | 6/1994 |
| JP | 6-210952 | A | 8/1994 |
| JP | 6-344671 | A | 12/1994 |
| JP | 7-089237 | A | 4/1995 |
| JP | 07-172057 | A | 7/1995 |
| JP | 7-290835 | A | 7/1995 |
| JP | 7-314896 | A | 12/1995 |
| JP | 7-314914 | A | 12/1995 |
| JP | 8-039937 | A | 2/1996 |
| JP | 8-118808 | A | 5/1996 |
| JP | 9-131969 | A | 5/1997 |
| JP | 9-142018 | A | 6/1997 |
| JP | 09-150584 | A | 6/1997 |
| JP | 10-217614 | A | 8/1998 |
| JP | 11-011024 | A | 1/1999 |
| JP | 11-48610 | A | 2/1999 |
| JP | 11-70736 | A | 3/1999 |
| JP | 11-208122 | A | 8/1999 |
| JP | 11-254837 | A | 9/1999 |
| JP | 11-291633 | A | 10/1999 |
| JP | 11-315557 | A | 11/1999 |
| JP | 11-342676 | A | 12/1999 |
| JP | 2000-168242 | A | 6/2000 |
| JP | 2000-247037 | A | 9/2000 |
| JP | 2000-247038 | A | 9/2000 |
| JP | 2000-263944 | A | 9/2000 |
| JP | 2000-326632 | A | 11/2000 |
| JP | 2000-345067 | A | 12/2000 |
| JP | 2000-347341 | A | 12/2000 |
| JP | 2001-113837 | A | 4/2001 |
| JP | 2001-150820 | A | 6/2001 |
| JP | 2001-162935 | A | 6/2001 |
| JP | 2001-219651 | | 8/2001 |
| JP | 2001-246863 | A | 9/2001 |
| JP | 2002-264534 | A | 9/2001 |
| JP | 2001-293956 | A | 10/2001 |
| JP | 2002-086910 | A | 3/2002 |
| JP | 2002-127601 | A | 5/2002 |
| JP | 2002-127604 | A | 5/2002 |
| JP | 2002-301873 | A | 10/2002 |
| JP | 2002-326459 | A | 11/2002 |
| JP | 2003-025734 | A | 1/2003 |
| JP | 2003-182245 | A | 7/2003 |
| JP | 2003-182248 | A | 7/2003 |
| WO | WO 00/53427 | A1 | 9/2000 |
| WO | WO 02/098673 | A1 | 12/2002 |
| WO | WO 03/002354 | A1 | 9/2003 |

OTHER PUBLICATIONS

Japanese Office Action, JP App. No. 2001-197200, Mar. 22, 2006.

* cited by examiner

THERMAL RECORDING MATERIAL

BACKGROUND OF THE INVENTION

1. Field of the Invention

The present invention relates to a thermal recording material, and particularly to a thermal recording material that places a small burden on the environment, high in sensitivity and superior in background fogging, image preservability, resistance to inkjet inks, chemical resistance and adaptability to inkjet printing. Further, the invention relates to a thermal recording material, and particularly to a thermal recording material that is high in sensitivity and superior in background fogging, image preservability, chemical resistance, thermal head matching characteristics (such as adhesion of scum to thermal head and abrasion properties of thermal head) and resistance to inkjet inks. Moreover, the invention relates to a thermal recording material, and particularly to a thermal recording material that is high in color density and superior in background fogging, image preservability and chemical resistance and is provided with adaptability to inkjet recording and adaptability to head scum.

2. Description of the Related Art

Since thermal recording materials are relatively inexpensive, and recording instruments thereof are compact and free from maintenance, the thermal recording materials are broadly used. And, in order to enhance the color density and image preservability of thermal recording materials, not only development of electron-donating colorless dyes and electron-accepting compounds but also study about the layer structure of thermal recording materials are being extensively carried out.

In recent years, a sales competition of heat-sensitive paper intensifies, and thermal recording materials are required to have higher functions that can be differentiated from the conventional functions. Accordingly, the thermal recording materials are extensively studied with respect to color density, image preservability, and the like.

In the conventional thermal recording materials, 2,2-bis (4-hydroxyphenyl)propane (bisphenol A or BPA) has been widely used as an electron-accepting compound against electron-donating colorless dyes to be used. However, satisfactory properties have not been obtained from the viewpoint of sensitivity, background fogging, image preservability, and so on.

On the other hand, JP-B No. 4-20792 discloses that recording materials using an N-substituted sulfamoylphenol or N-substituted sulfamoylnaphthol as the electron-accepting compound improve image density, image stability, cost, etc. of the (pressure-sensitive or heat-sensitive) recording materials. However, there is room for further improvements in the image density and image preservability.

In recent years, from an increase of consciousness to the environment, a demand of thermal recording materials using a support composed mainly of waste paper pulp (so-called "recycled paper") is rising. However, when recycled paper is used as a support, the background fogging and image preservability become worse, and satisfactory thermal recording materials have not always been obtained. In particular, when the above mentioned BPA is used as a color developer in the generated paper, the background fogging and image preservability become worse.

As the thermal recording materials using recycled paper, JP-A No. 3-140287 describes a thermal recording material using a phenol-based color developer (including bisphenol-based color developers), a sulfone-based color developer, or a hydroxybenzoic acid-based color developer, in which recycled paper having a measured value of 8% or more by a regular reflection type smoothness sensor under a pressure condition of 20 kg/cm$^2$ in terms of original paper surface is used, thereby improving the recording sensitivity without generation of background stains, resulting in enabling to make it correspond to super high-speed machines. However, such a thermal recording material is not satisfactory in image preservability.

JP-A No. 4-21486 describes a thermal recording material having a good color re-developing performance (color-developing properties after preservation) even when recycled paper is used as the support, in which bis(4-hydroxyphenyl)acetate-n-butyl, 4-hydroxy-4-isopropoxydiphenylsulfone, 4,4'-thiobis(3-methyl-6-tert-butylphenol), or N,N'-diphenyl thiourea is used as a color developer. However, the thermal recording material described in this patent document is not satisfactory in background fogging and image preservability.

Further, in recent years, inkjet prints become widespread as output applications from personal computers, and there is often seen in offices and so on the state where the recording surfaces of inkjet recording materials and those of thermal recording materials are placed overlaid each other. There occur problems of a fog of the background portion of the thermal recording material and a reduction in density of image portions in the conventional thermal recording materials, when the recording surface of the thermal recording material is brought into contact with the recording surface of the inkjet recording material, since the conventional thermal recording materials do not have enough resistance against inkjet inks.

In addition, when full-color information is recorded on thermal recording materials, recording using inkjet inks is often employed. When inkjet printing is performed on usual thermal recording materials, there may be the case where colors of the inks are not precisely reproduced, and vivid colors do not appear, whereby the resulting colors become dull. And, when inkjet recording is performed on the thermal recording material described in JP-B No. 4-20792, there is a problem that the colors are dull and blackish.

SUMMARY OF THE INVENTION

In view of the foregoing problems, the present invention has been made. A first object of the invention is to provide a thermal recording material using, as a support, so-called recycled paper composed mainly of waste paper pulp, which is high in sensitivity, less in background fogging and superior in preservability of image portions, with resistance against inkjet inks and chemicals and adaptability to inkjet printing.

A second object of the invention is to provide a thermal recording material that is high in sensitivity, less in background fogging and superior in preservability of image portions, with resistance against inkjet inks and chemicals and with good thermal head matching characteristics (such as adhesion of scum to thermal head and abrasion properties of thermal head).

A third object of the invention is to provide a thermal recording material that is high in color density, less in background fogging and superior in preservability of image portions with chemical resistance of image portions and background portions, and is provided with adaptability to inkjet recording and adaptability to head scum.

These objects are achieved by providing the following thermal recording materials.

A first embodiment of the invention provides a thermal recording material comprising a support and a heat-sensitive color-developing layer disposed on the support, the heat-sensitive color-developing layer containing an electron-donating colorless dye and an electron-accepting compound, wherein the heat-sensitive color-developing layer contains 4-hydroxybenzenesulfone anilide as the electron-accepting compound, and the support contains waste paper pulp as a primary component thereof.

A second embodiment of the invention provides the thermal recording material of the first embodiment, wherein the heat-sensitive color-developing layer further contains a basic pigment.

A third embodiment of the invention provides the thermal recording material of the second embodiment, wherein the basic pigment is at least one selected from the group consisting of bur-shaped calcium carbonate, aluminum hydroxide, basic magnesium carbonate, and magnesium oxide.

A fourth embodiment of the invention provides the thermal recording material of the first embodiment, wherein the heat-sensitive color-developing layer contains at least one selected from 2-anilino-3-methyl-6-di-n-butylaminofluorane, 2-anilino-3-methyl-6-di-n-amylaminofluorane, and 2-anilino-3-methyl-6-(N-ethyl-N-p-benzyl)aminofluorane as the electron-donating colorless dye.

A fifth embodiment of the invention provides the thermal recording material of the fourth embodiment, wherein the support has a paper surface pH of 6 to 9.

A sixth embodiment of the invention provides a thermal recording material comprising a support and a heat-sensitive color-developing layer disposed on the support, the heat-sensitive color-developing layer containing an electron-donating colorless dye and an electron-accepting compound, wherein the heat-sensitive color-developing layer contains 4-hydroxybenzenesulfone anilide as the electron-accepting compound and further contains at least one of calcium carbonate of calcite type, amorphous silica, and aluminum hydroxide as an inorganic pigment.

A seventh embodiment of the invention provides the thermal recording material of the sixth embodiment, wherein a content of the inorganic pigment is from 50 to 250 parts by weight based on 100 parts by weight of the electron-accepting compound.

An eighth embodiment of the invention provides the thermal recording material of the sixth or seventh embodiment, wherein the inorganic pigment has a volume average particle size of 0.6 to 3.0 μm.

A ninth embodiment of the invention provides the thermal recording material of any one of the sixth to eighth embodiments, wherein the support has an undercoat layer containing calcined kaolin having an oil absorbency, as defined in JIS-K5101, of 70 to 80 mL/100 g, and the undercoat layer is provided by blade coating.

A tenth embodiment of the invention provides a thermal recording material comprising a support and a heat-sensitive color-developing layer disposed on the support, the heat-sensitive color-developing layer containing an electron-donating colorless dye and an electron-accepting compound, wherein the heat-sensitive color-developing layer contains 4-hydroxybenzenesulfone anilide as the electron-accepting compound and contains at least one selected from 2-anilino-3-methyl-6-di-n-butylaminofluorane, 2-anilino-3-methyl-6-di-n-amylaminofluorane, and 2-anilino-3-methyl-6-(N-ethyl-N-p-benzyl)aminofluorane as the electron-donating colorless dye; and the heat-sensitive color-developing layer is formed by using a pigment dispersion having a pH of 7 to 10.

An eleventh embodiment of the invention provides the thermal recording material of the tenth embodiment, wherein the pigment is one selected from calcium carbonate and aluminum hydroxide.

DETAILED DESCRIPTION OF THE INVENTION

The thermal recording material of the present invention will be hereunder described with respect to support and heat-sensitive color-developing layer in this order.

<<1. Support>>

The support that is used in the thermal recording materials of the first to fifth embodiments of the invention contains waste paper pulp as a primary component. That is, the support is characterized in that the waste paper pulp accounts for 50% by weight or more of the support.

The waste paper pulp is generally prepared from a combination of the following three steps.

(1) Disaggregation:

Waste paper is treated by a mechanical force and with chemicals by a pulper and loosened into a fibrous form, and printing ink is removed from the fibers.

(2) Dust removal:

Foreign matters (such as plastics) and dusts contained in the waste paper are removed.

(3) Deinking:

The printing inks peeled apart from the fibers are removed off the system by flotation or cleaning.

Bleaching may be performed simultaneously with the deinking step or in a separate step, when necessary.

Using 100% by weight of the thus obtained waste paper pulp or a mixture of the waste paper pulp and less than 50% by weight of virgin pulp, a support for thermal recording material is formed in the ordinary method.

As the foregoing support, a support having a smoothness, as defined in JIS-P8119, of 100 seconds or more, and preferably of 150 seconds or more is preferred from a viewpoint of dot reproducibility.

Further, in the thermal recording materials of the fourth and fifth embodiments, it is preferred from the viewpoints of sensitive, background fogging and image preservability that the support surface has a paper surface pH of 6 to 9.

As the support used in the thermal recording materials of the sixth to eleventh embodiments of the invention, a conventionally known support can be used. Concrete examples thereof include a paper support such as fine quality paper, coat paper such as paper having a resin or pigment coated thereon, resin-laminated paper, undercoated original paper provided with an undercoat layer, synthetic paper, and plastic films. From a viewpoint of thermal head matching characteristics, undercoated original paper having an undercoat layer is preferred, and undercoated original paper having an undercoat layer containing an oil-absorbing pigment using a blade coater is particularly preferred.

As the support in the thermal recording materials of the sixth to ninth embodiments of the invention, a support having a smoothness, as defined in JIS-P8119, of 300 seconds or more is preferred from the viewpoint of dot reproducibility.

As described previously, it is preferred that the support to be used in the thermal recording materials of the sixth to ninth embodiments of the invention has an undercoat layer. Preferably, the undercoat layer is provided on a support having a Stoeckigt size of 5 seconds or more and is made of a pigment and a binder as major components.

As the support in the thermal recording materials of the tenth and eleventh embodiments of the invention, a support having a smoothness, as defined in JIS-P8119, falling within the range of 300 seconds to 500 seconds is preferred from a viewpoint of dot reproducibility.

In addition, the support that is used in the invention may be provided with an undercoat layer. When the undercoat layer is provided on the support, it is preferred that an undercoat layer made of a pigment as a major component is provided on the support. As the pigment, all of general inorganic or organic pigments can be used, but pigments having an oil absorbency, as defined in JIS-K5101, of 40 mL/100 g (cc/100 g) or more are particularly preferred. Specific examples include calcium carbonate, barium sulfate, aluminum hydroxide, kaolin, calcined kaolin, amorphous silica, and urea-formalin resin powders. Of these is especially preferable calcined kaolin having an oil absorbency, as defined above, of 70 mL/100 g to 80 mL/100 g. In the thermal recording materials of the fourth and fifth embodiments of the invention, calcined kaolin having an oil absorbency, as defined above, of 70 mL/100 g or more is especially preferred.

When the pigment is applied onto the support, the content of the pigment is 2 $g/m^2$ or more, preferably 4 $g/m^2$ or more, and particularly preferably from 7 $g/m^2$ to 12 $g/m^2$.

As the binder that is used in the undercoat layer, are enumerated water-soluble polymers and aqueous binders. These materials may be used singly or in mixture of two or more thereof.

Examples of the water-soluble polymers include starch, polyvinyl alcohol, polyacrylamide, carboxymethyl alcohol, methyl cellulose, and casein.

The aqueous binders are generally synthetic rubber latices or synthetic resin emulsions, and the examples thereof include a styrene-butadiene rubber latex, an acrylonitrile-butadiene rubber latex, a methyl acrylate-butadiene rubber latex, and a vinyl acetate emulsion.

The amount of the binder to be used is from 3 to 100% by weight, preferably from 5 to 50% by weight, and particularly preferably from 8 to 15% by weight on a basis of the pigment to be added to the undercoat layer. Further, to the undercoat layer, may be added waxes, discoloration-preventing agents, surfactants, etc.

For the application of the undercoat layer, known application methods may be used. Concrete methods to be used are an air knife coater, a roll coater, a blade coater, a gravure coater, a curtain coater, or the like. Among them the method using a blade coater is preferred. Further, the undercoat layer may be subjected to smoothening processing such as calendering, if necessary.

The method using a blade coater is not limited to coating methods using a bevel type or vent type blade, but includes rod blade coating and bill blade coating. Further, the coating method is not limited to an off-machine coater, but an on-machine coater installed in a paper-making machine. In order to obtain superior smoothness and surface properties by imparting fluidity during blade coating, carboxymethyl cellulose having a degree of etherification of 0.6 to 0.8 and a weight average molecular weight of 20,000 to 200,000 may be added in an amount of 1 to 5% by weight, and preferably from 1 to 3% by weight on a basis of the pigment to the coating solution for undercoat layer.

The coating amount of the undercoat layer is not particularly limited, but is usually 2 $g/m^2$ or more, preferably 4 $g/m^2$ or more, and particularly preferably from 7 $g/m^2$ to 12 $g/m^2$ according to the characteristics of the thermal recording material.

<<2. Heat-sensitive Color-developing Layer>>

<Electron-donating Colorless Dye>

In the thermal recording materials of the first to fifth embodiments of the invention, it is preferred that the heat-sensitive color-developing layer to be formed on the support contains at least an electron-donating colorless dye and an electron-accepting compound and may further contain a sensitizer, a pigment and an image stabilizer.

As the electron-donating colorless dyes in the thermal recording materials of the first to third embodiments of the invention, are numerated the following compounds, but it should not be construed that the invention is limited thereto.

Examples of the electron-donating colorless dyes that develop into black include 3-di(n-butylamino)-6-methyl-7-anilinofluorane, 2-anilino-3-methyl-6-N-ethyl-N-sec-butylaminofluorane, 3-di(n-pentylamino)-6-methyl-7-anilinofluorane, 3-(N-isoamyl-N-ethylamino)-6-methyl-7-anilinofluorane, 3-(N-n-hexyl-N-ethylamino)-6-methyl-7-anilinofluorane, 3-[N-(3-ethoxypropyl)-N-ethylamino]-6-methyl-7-anilinofluorane, 3-di(n-butylamino)-7-(2-chloroanilino)fluorane, 3-diethylamino-7-(2-chloroanilino)fluorane, 3-diethylamino-6-methyl-7-anilinofluorane, and 3-(N-cyclohexyl-N-methylamino)-6-methyl-7-anilinofluorane.

Of these, 3-di(n-butylamino)-6-methyl-7-anilinofluorane, 2-anilino-3-methyl-6-N-ethyl-N-sec-butylaminofluorane, and 3-diethylamino-6-methyl-7-anilinofluorane are preferred from the viewpoint of background fogging of non-image portions.

The coating amount of the electron-donating colorless dye is preferably from 0.1 to 1.0 $g/m^2$, and more preferably from 0.2 to 0.5 $g/m^2$ from the viewpoints of color density and background fogging density.

In the thermal recording materials of the fourth and fifth embodiments of the invention, when at least one selected from 2-anilino-3-methyl-6-di-n-butylaminofluorane, 2-anilino-3-methyl-6-di-n-amylaminofluorane, and 2-anilino-3-methyl-6-(N-ethyl-N-p-benzyl)aminofluorane is contained as the electron-donating colorless dye, even a thermal recording material in which the support is composed mainly of waste paper pulp exhibits effects such that it is high in sensitivity, less in background fogging and superior in preservability of image portions, chemical resistance and adaptability to inkjet printing.

In the invention, when the foregoing known electron-donating colorless dyes are jointly used, the content of at least one selected from 2-anilino-3-methyl-6-di-n-butylaminofluorane, 2-anilino-3-methyl-6-di-n-amylaminofluorane, and 2-anilino-3-methyl-6-(N-ethyl-N-p-benzyl)aminofluorane according to the invention is preferably 50% by weight or more, and particularly preferably 70% by weight or more in the whole of the electron-donating colorless dyes.

In the thermal recording materials of the sixth to ninth embodiments of the invention, the heat-sensitive color-developing layer to be formed on the support contains at least an electron-donating colorless dye, an electron-accepting compound and inorganic pigment and may further contain a sensitizer and an image stabilizer.

In the thermal recording materials of the sixth to ninth embodiments of the invention, it is preferred that the electron-donating colorless dye is at least one selected from 2-anilino-3-methyl-6-diethylaminofluorane, 2-anilino-3-methyl-6-(N-ethyl-N-isoamylamino)fluorane, and 2-anilino-3-methyl-6-(N-ethyl-N-propylamino)fluorane. These compounds may be used singly or in mixture of two or more thereof.

By using at least one selected from 2-anilino-3-methyl-6-diethylaminofluorane, 2-anilino-3-methyl-6-(N-ethyl-N-isoamylamino)fluorane, and 2-anilino-3-methyl-6-(N-ethyl-N-propylamino)fluorane as the electron-donating colorless dye, it becomes possible to enhance the preservability of image portions and chemical resistance.

Other examples for the electron-donating colorless dye include, besides the foregoing compounds, 3-di(n-butylamino)-6-methyl-7-anilinofluorane, 2-anilino-3-methyl-6-N-ethyl-N-sec-butylaminofluorane, 3-di(n-pentylamino)-6-methyl-7-anilinofluorane, 3-(N-n-hexyl-N-ethylamino)-6-methyl-7-anilinofluorane, 3-[N-(3-ethoxypropyl)-N-ethylamino]-6-methyl-7-anilinofluorane, 3-di(n-butylamino)-7-(2-chloroanilino)fluorane, 3-diethylamino-7-(2-chloroanilino)fluorane, and 3-(N-cyclohexyl-N-methylamino)-6-methyl-7-anilinofluorane. Further, these compounds may be used singly or in mixture of two or more thereof.

The coating amount of the electron-donating colorless dye is preferably from 0.1 to 1.0 g/m$^2$, and more preferably from 0.2 to 0.5 g/m$^2$ from the viewpoints of color density and background fogging density.

In the thermal recording materials of the tenth and eleventh embodiments of the invention, the heat-sensitive color-developing layer to be formed on the support contains at least an electron-donating colorless dye and an electron-accepting compound and may further contain a sensitizer, an image stabilizer and a UV absorber.

The thermal recording materials of the tenth and eleventh embodiments of the invention are characterized in that the electron-donating colorless dye is at least one selected from 2-anilino-3-methyl-6-di-n-butylaminofluorane, 2-anilino-3-methyl-6-di-n-amylaminofluorane, and 2-anilino-3-methyl-6-(N-ethyl-N-p-benzyl)aminofluorane. These compounds may be used singly or in mixture of two or more thereof.

By using at least one selected from 2-anilino-3-methyl-6-di-n-butylaminofluorane, 2-anilino-3-methyl-6-di-n-amylaminofluorane, and 2-anilino-3-methyl-6-(N-ethyl-N-p-benzyl)aminofluorane as the electron-donating colorless dye, it becomes possible to further enhance the color density and preservability of image portions.

Further, so far as the effects of the invention are not hindered, other known electron-donating colorless dyes than the foregoing 2-anilino-3-methyl-6-di-n-butylaminofluorane, 2-anilino-3-methyl-6-di-n-amylaminofluorane, and 2-anilino-3-methyl-6-(N-ethyl-N-p-benzyl)aminofluorane may be jointly used as the electron-donating colorless dye.

Examples of such other known electron-donating colorless dyes that can be used include 3-di(n-butylamino)-6-methyl-7-anilinofluorane, 2-anilino-3-methyl-6-N-ethyl-N-sec-butylaminofluorane, 3-di(n-pentylamino)-6-methyl-7-anilinofluorane, 3-(N-isoamyl-N-ethylamino)-6-methyl-7-anilinofluorane, 3-(N-n-hexyl-N-ethylamino)-6-methyl-7-anilinofluorane, 3-[N-(3-ethoxypropyl)-N-ethylamino]-6-methyl-7-anilino-fluorane, 3-di(n-butylamino)-7-(2-chloroanilino)fluorane, 3-diethylamino-7-(2-chloroanilino)fluorane, 3-diethylamino-6-methyl-7-anilinofluorane, and 3-(N-cyclohexyl-N-methylamino)-6-methyl-7-anilinofluorane.

In the invention, when the foregoing known electron-donating colorless dyes are jointly used, the content of any one selected from 2-anilino-3-methyl-6-di-n-butylaminofluorane, 2-anilino-3-methyl-6-di-n-amylaminofluorane, and 2-anilino-3-methyl-6-(N-ethyl-N-p-benzyl)aminofluorane is preferably 50% by weight or more, and particularly preferably 90% by weight or more in the whole of the electron-donating colorless dyes.

<Electron-accepting Compound>

The thermal recording material of the invention is characterized by containing 4-hydroxybenzenesulfone anilide as the electron-accepting compound.

The amount of the electron-accepting compound is preferably from 50 to 400% by weight, and particularly preferably from 10 to 300% by weight on a basis of the electron-donating colorless dye.

In the invention, so far as the effect of the invention is not hindered, other known electron-accepting compounds than 4-hydroxybenzenesulfone anilide may be jointly used as the electron-accepting compound.

The known electron-accepting compounds can be suitably selected and used, but phenolic compounds or salicylic acid derivatives and polyvalent metal salts thereof are particularly preferred from the viewpoint of inhibition of the background fogging.

Examples of the phenolic compounds include 2,2'-bis(4-hydroxyphenol)propane (bisphenol A), 4-t-butylphenol, 4-phenylphenol, 4-hydroxydiphenoxide, 1,1'-bis(4-hydroxyphenyl)cyclohexane, 1,1'-bis(3-chloro-4-hydroxyphenyl)cyclohexane, 1,1'-bis(3-chloro-4-hydroxyphenyl)-2-ethylbutane, 4,4'-sec-isooctylidene diphenol, 4,4'-sec-butylene diphenol, 4-tert-octylphenol, 4-p-methylphenyl phenol, 4,4'-methylcyclohexylidene phenol, 4,4'-isopentylidene phenol, 4-hydroxy-4-isopropyloxydiphenyl-sulfone, benzyl p-hydroxybenzoate, 4,4'-dihydroxydiphenylsulfone, 2,4'-dihydroxydiphenylsulfone, 2,4-bis(phenylsulfonyl)phenol, and N-(4-hydroxyphenyl)-p-toluene sulfonamide.

Examples of the salicylic acid derivatives include 4-pentadecyl salicylate, 3,5-di(α-methylbenzyl)salicylate, 3,5-di(tert-octyl)salicylate, 5-octadecyl salicylate, 5-α-(p-α-methylbenzylphenyl)ethyl salicylate, 3-α-methylbenzyl-5-tert-octyl salicylate, 5-tetradecyl salicylate, 4-hexyloxy salicylate, 4-cyclohexyloxy salicylate, 4-decyloxy salicylate, 4-dodecyloxy salicylate, 4-pentadecyloxy salicylate, 4-octadecyloxy salicylate, and their zinc, aluminum, calcium, copper, and lead salts.

In the invention, when the foregoing known electron-accepting compounds are jointly used, the content of the 4-hydroxybenzenesulfone anilide according to the invention is preferably 50% by weight or more, and particularly preferably 70% by weight or more in the whole of the electron-accepting compounds.

In the invention, when a coating solution for the heat-sensitive color-developing layer is prepared, the particle size of the electron-accepting compound is preferably 1.0 μm or less, and more preferably from 0.5 to 0.7 μm in terms of volume average particle size. When the volume average particle size exceeds 1.0 μm, the color density may possibly lower. The volume average particle size can be easily measured by a laser diffraction type particle size distribution measurement device (for example, LA500 (trade name) manufactured by Horiba, Ltd.), etc.

<Sensitizer>

The thermal recording material of the invention preferably contains at least one selected from 2-benzyloxynaphthalene, dimethylbenzyl oxalate, m-terphenyl, ethylene glycol tolyl ether, p-benzylbiphenyl, and 1,2-diphenoxymethylbenzene as a sensitizer in the heat-sensitive color-developing layer. By containing such a sensitizer, it becomes possible to enhance the sensitivity more largely.

The content of the sensitizer is preferably from 75 to 200 parts by weight, and more preferably from 100 to 150 parts by weight based on 100 parts by weight of 4-hydroxybenzenesulfone anilide as the electron-accepting compound. When the content of the sensitizer falls within the range of 75 to 200 parts by weight, not only the effect of enhancement of the sensitivity is large, but also the image preservability is good.

So far as the effects of the invention are not hindered, other sensitizers than the foregoing sensitizers may be jointly used in the heat-sensitive color-developing layer according to the invention. When other sensitizers are contained, the content of the foregoing sensitizer is preferably 50% by weight or more, and more preferably 70% by weight or more of the whole of the sensitizers.

Examples of such other sensitizers include aliphatic monoamides, stearylurea, p-benzylbiphenyl, di(2-methylphenoxy)ethane, di(2-methoxy-phenoxy)ethane, β-naphthol-(p-methylbenzyl)ether, α-naphthylbenzyl ether, 1,4-butanediol-p-methylphenyl ether, 1,4-butanediol-p-isopropylphenyl ether, 1,4-butanediol-p-tert-octylphenyl ether, 1-phenoxy-2-(4-ethylphenoxy)ethane, 1-phenoxy-2-(chlorophenoxy)ethane, 1,4-butanediolphenyl ether, diethylene glycol bis(4-methoxyphenyl)ether, m-terphenyl, methyl oxalate benzyl ether, 1,2-diphenoxymethylbenzene, 1,2-bis(3-methylphenoxy)ethane, and 1,4-bis(phenoxymethyl)benzene.

<Pigment>

In the thermal recording materials of the first to fifth embodiments of the invention, it is preferred that a pigment is contained in the thermal recording layer. As the pigment, can be used at least one of amorphous silica, cubic system calcium carbonate, bur-shaped (calcite type) calcium carbonate, aluminum hydroxide, kaolin, magnesium carbonate, and magnesium oxide. Of these, basic pigments such as calcium carbonate, aluminum hydroxide, basic magnesium carbonate, and magnesium oxide are preferably used from the viewpoint of obtaining thermal recording materials that are less in background fogging. Further, in order to control the abrasion properties of thermal head, pigments having a Mohs Hardness of 3 or less are preferred. The term "Mohs Hardness" as referred to herein means "Mohs Hardness" as described on page 616 of *Eiwa Purasuchikku Kogyo Jiten* (English-Japanese, Plastic Industry Dictionary), 5th Ed. (Noboru Ogawa, published by Kogyo Chosakai Publishing Co., Ltd.). Examples of the basic pigments having a Mohs Hardness of 3 or less include aluminum hydroxide and calcium carbonate and so on.

Among the calcium carbonate pigments, calcium carbonate of calcite type (bur-shaped calcium carbonate) is preferred from the viewpoint of color density by recording by a thermal head.

The bur-shaped (calcite type) calcium carbonate preferably has a particle size of 1 to 3 μm. Further, kaolin preferably has a particle size of 1 to 3 μm. Other pigments such as aluminum hydroxide preferably have a mean particle size in the range of 0.3 to 1.5 μm, and more preferably from 0.5 to 0.9 μm.

When basic magnesium carbonate or magnesium oxide is used in mixture with other pigment, such is preferred from the viewpoint of background fogging. In that case, the content of basic magnesium carbonate or magnesium oxide is preferably from 3 to 50% by weight, and particularly preferably from 5 to 30% by weight in the whole of the pigments.

In the invention, the amount of the pigment to be used is preferably from 50 to 1000% by weight, and more preferably from 100 to 500% by weight on a basis of the electron-donating colorless dye.

<Inorganic Pigment>

The heat-sensitive color-developing layer according to the thermal recording materials of the sixth to ninth embodiments of the invention is characterized by containing at least one of calcium carbonate of calcite type, amorphous silica, and aluminum hydroxide as an inorganic pigment.

The content of the inorganic pigment is preferably from 50 to 250 parts by weight, more preferably from 70 to 170 parts by weight, and particularly preferably from 90 to 140 parts by weight based on 100 parts by weight of the electron-accepting compound from the viewpoints of color density and adhesion of scum to thermal head.

The particle size of the inorganic pigment is preferably from 0.6 to 2.5 μm, more preferably from 0.8 to 2.0 μm, and particularly preferably from 1.0 to 1.6 μm in terms of volume average particle size from the viewpoints of color density and adhesion of scum to thermal head.

Generally, light calcium carbonate includes crystal forms such as calcite, aragonite, and vaterite. However, it is preferred from the viewpoints of absorption and hardness to use light calcium carbonate of calcite type as the inorganic pigment according to the invention, and the light calcium carbonate of calcite type preferably has a particle shape such as a spindle form and a scalendedral form.

As the manufacturing process of the light calcium carbonate of calcite type, the known manufacturing processes can be employed.

Further, so far as the effects of the invention are not hindered, other inorganic pigments than those as described above may be jointly used. Examples of other inorganic pigments than the light calcium carbonate of calcite type include calcium carbonate, barium sulfate, lithopone, agalmatolite, kaolin, calcined kaolin, and amorphous silica. When the inorganic pigment according to the invention is jointly used with the foregoing other inorganic pigments, a ratio (v/w) (a ratio of the total weight (v) of the inorganic pigment of the invention to the total weight (w) of the foregoing other inorganic pigment) is preferably from 100/0 to 60/40, and more preferably from 100/0 to 80/20.

The heat-sensitive color-developing layer according to the thermal recording materials of the tenth and eleventh embodiments of the invention is characterized by being formed by using a pigment dispersion having a pH of 7 to 10. By using the pigment whose dispersion has a pH of 7 to 10, background fogging of the thermal recording materials exhibits improved properties. When the pH is less than 7, the background fogging is large, whereas when it exceeds 10, the sensitivity lowers, and hence, such is not preferred.

The pigment is preferably at least one selected from calcium carbonate, aluminum hydroxide, and kaolin. It is particularly preferred from the viewpoints of absorption and hardness to use light calcium carbonate of calcite type as the inorganic pigment according to the invention, and the light calcium carbonate of calcite type preferably has a particle shape such as a spindle form and a scalendedral form.

As the manufacturing process of the light calcium carbonate of calcite type, the known manufacturing processes can be employed.

The content of the inorganic pigment is preferably from 50 to 250 parts by weight, more preferably from 70 to 170 parts by weight, and particularly preferably from 90 to 140 parts by weight based on 100 parts by weight of the electron-accepting compound from the viewpoints of color density and adhesion of scum to thermal head.

The particle size of the inorganic pigment is preferably from 0.6 to 2.5 μm, more preferably from 0.8 to 2.0 μm, and particularly preferably from 1.0 to 1.6 μm in terms of volume average particle size from the viewpoints of color density and adhesion of scum to thermal head.

<Image Stabilizer>

In addition, it is possible to further enhance the preservability of image portions by containing an image stabilizer in the heat-sensitive color-developing layer.

The amount of the image stabilizer to be used is preferably from 10 to 100 parts by weight, and more preferably from 30 to 60 parts by weight based on 100 parts by weight of the electron-donating colorless dye. When the amount of the image stabilizer to be used is less than 10 parts by weight, the desired effects in background fogging and image preservability are not exhibited, whereas when it exceeds 100 parts by weight, an increase of the effects is small.

As the image stabilizer, phenol compounds, especially hindered phenol compounds are effective. Examples include 1,1,3-tris(2-methyl-4-hydroxy-5-tert-butylphenyl)butane, 1,1,3-tris(2-ethyl-4-hydroxy-5-cyclohexylphenyl)butane, 1,1,3-tris(3,5-di-tert-butyl-4-hydroxyphenyl)butane, 1,1,3-tris(2-methyl-4-hydroxy-5-tert-butylphenyl)propane, 2,2'-methylene-bis(6-tert-butyl-4-methylphenol), 2,2'-methylene-bis(6-tert-butyl-4-ethylphenol), 4,4'-butylidene-bis(6-tert-butyl-3-methylphenol), and 4,4'-thio-bis(3-methyl-6-tert-butylphenol).

In the thermal recording materials of the tenth and eleventh embodiments of the invention, the heat-sensitive color-developing layer may further contain a UV absorber.

Examples of the UV absorber are given below.

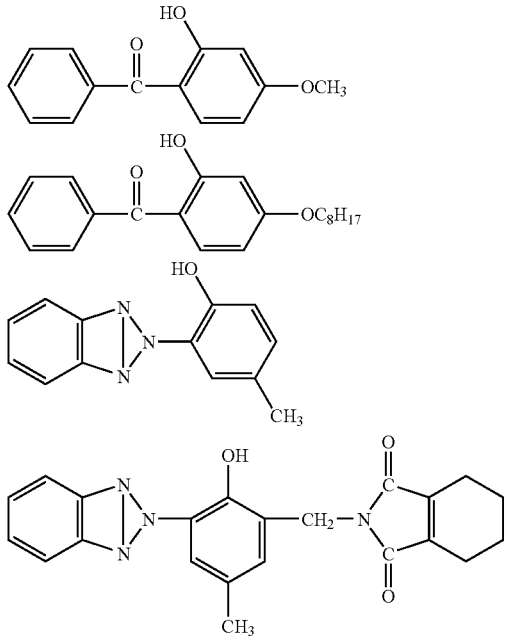

-continued

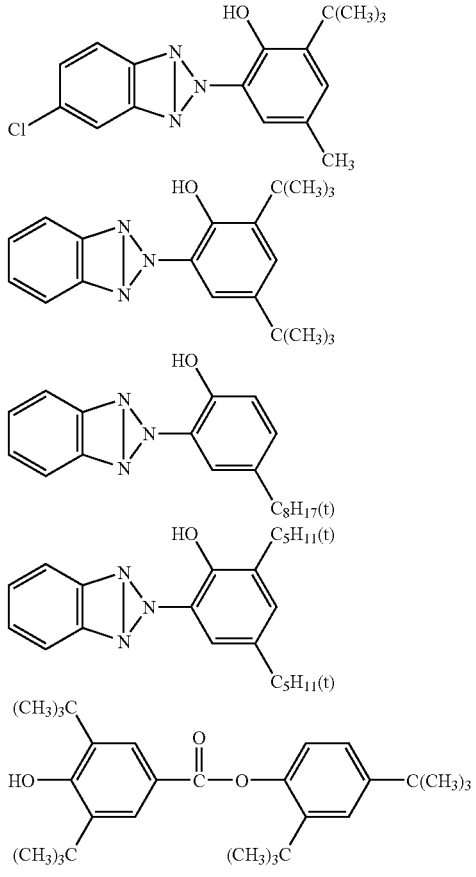

In the invention, dispersion of the electron-donating colorless dye, electron-accepting compound and sensitizer, etc. can be performed in a water-soluble binder. The water-soluble binder to be used in this case is preferably a compound that is dissolved in an amount of 5% by weight or more in water at 25° C.

Specific examples of the water-soluble binder include polyvinyl alcohol, methyl cellulose, carboxymethyl cellulose, starches (including modified starches), gelatin, gum arabic, casein, and saponification products of a styrene-maleic anhydride copolymer.

The binder is used not only during the dispersion but also for the purpose of enhancing the coating film strength of the heat-sensitive color-developing layer. In order to achieve this purpose, synthetic polymer latex-based binders such as styrene-butadiene copolymers, vinyl acetate copolymers, acrylonitrile-butadiene copolymers, methyl acrylate-butadiene copolymers, and polyvinylidene chloride can also be jointly used.

The foregoing electron-donating colorless dye, electron-accepting compound and sensitizer, etc. are dispersed simultaneously or separately by a stirrer or pulverizer such as a ball mill, an attritor, and a sand mill and prepared as a coating solution. In the coating solution, may be further added metallic soaps, waxes, surfactants, antistatics, UV absorbers, antifoaming agents, fluorescent dyes, etc., if necessary.

Examples of the metallic soaps include higher fatty acid metal salts such as zinc stearate, potassium stearate, and aluminum stearate.

Examples of the waxes include paraffin wax, microcrystalline wax, carnauba wax, methylol stearamide, polyethylene wax, polystyrene wax, and fatty acid amide-based waxes. These waxes may be used singly or in mixture. Examples of the surfactants include alkali metal salts or ammonium salts of alkylbenzenesulfonic acids, sulfosuccinic acid-based alkali metal salts, and fluorine-containing surfactants.

In the thermal recording material of the invention, in order to impart adaptability to inkjet recording, it is effective to use a cationic polymer. The cationic polymer may be added to any of the thermal recording layer and the protective layer. Examples of the cationic polymer include polyethyleneimine, polydiallylamine, polyallylamine, polydiallyldimethylammonium chloride, polymethacryloyloxyethyl β-hydroxyethyldimethylammonium chloride, polyallylamine hydrochloride, polyamide-polyamine resins, cationic starches, dicyanediamide-formalin condensates, dimethyl 2-hydroxypropylammonium salt polymers, polyamidines, and polyvinylamines.

These materials are mixed and then applied onto the support. The application method is not particularly limited, but the mixture is applied by using, for example, an air knife coater, a roll coater, a blade coater, or a curtain coater, dried, subjected to smoothening processing by calendering, and then put into use. The method using a curtain coater is particularly preferred in the invention.

Further, the coating amount of the heat-sensitive color-developing layer is not limited, but is usually preferably from about 2 to 7 g/m$^2$ by dry weight.

In addition, the thermal recording material of the invention preferably has an image retention rate of 65% or more. The image retention rate is expressed by a rate of the image density of an image after being stored in an atmosphere at 60° C. and at a relative humidity of 20% for 24 hours to the image density measured immediately after printing by a Macbeth reflection densitometer (for example, RD-918).

Image retention rate=[(Image density after being stored under the above condition)/(Image density immediately after printing)]×100

A protective layer can be provided on the heat-sensitive color-developing layer, if necessary. The protective layer can contain organic or inorganic fine powders, binders, surfactants, thermoplastic substances, etc. Examples of the fine powders include inorganic fine powders such as calcium carbonate, silica, zinc oxide, titanium oxide, aluminum hydroxide, zinc hydroxide, barium sulfate, clay, talc, and surface-processed calcium or silica; and organic fine powders such as urea-formalin resins, styrene/methacrylic acid copolymers, and polystyrene.

Examples of the binders that can be used in the protective layer include polyvinyl alcohol, carboxy-modified polyvinyl alcohol, vinyl acetate-acrylamide copolymers, silicon-modified polyvinyl alcohol, starches, modified starches, methyl cellulose, carboxymethyl cellulose, hydroxymethyl cellulose, gelatins, gum arabic, casein, styrene-maleic acid copolymer hydrolyzates, polyacrylamide derivatives, polyvinylpyrrolidone, and latices such as a styrene-butadiene rubber latex, an acrylonitrile-butadiene rubber latex, a methyl acrylate-butadiene rubber latex, and a vinyl acetate emulsion.

Further, it is possible to add a waterproofing agent that crosslinks the binder component in the protective layer to further enhance the preservability of the thermal recording layer. Examples of the waterproofing agent include water-soluble initial condensates such as N-methylolurea, N-methylolmelamine, and urea-formalin; dialdehyde compounds such as glyoxal and glutaraldehyde; inorganic crosslinking agents such as boric acid, borax, and colloidal silica; and polyamide epichlorohydrin.

EXAMPLES

The present invention will be specifically described below with reference to the following Examples, but it should not be construed that the invention is limited thereto. Further, all parts and percentages are parts by weight and % by weight, unless otherwise indicated.

The mean particle size was measured by using LA500 (trade name, manufactured by Horiba, Ltd.)

Example 1

(Preparation of Coating Solution for Heat-sensitive Color-developing Layer)

<Preparation of Solution A (Electron-donating Colorless Dye)>

Using the following composition, dispersion having a mean particle size of 0.8 μm was obtained by a ball mill.

| | |
|---|---|
| 3-Diethylamino-6-methyl-7-anilinofluorane: | 10 parts |
| 2.5% solution of polyvinyl alcohol (trade name: PVA-105 (degree of hydrolysis: 98.5% by mole, degree of polymerization: 500), manufactured by Kuraray Co., Ltd.): | 50 parts |

<Preparation of Solution B (Electron-accepting Compound)>

Using the following composition, dispersion having a mean particle size of 0.8 μm was obtained by a ball mill.

| | |
|---|---|
| 4-Hydroxybenzenesulfone anilide: | 20 parts |
| 2.5% solution of polyvinyl alcohol (trade name: PVA-105): | 100 parts |

<Preparation of Solution C (Sensitizer)>

Using the following composition, dispersion having a mean particle size of 0.8 μm was obtained by a ball mill.

| | |
|---|---|
| 2-Benzyloxynaphthalene: | 20 parts |
| 2.5% solution of polyvinyl alcohol (trade name: PVA-105): | 100 parts |

<Preparation of Solution D (Pigment)>

Using the following composition, a pigment dispersion having a mean particle size of 2.0 μm was obtained by a sand mill.

| | |
|---|---|
| Amorphous silica (trade name: MIZUKASIL P-832, manufactured by Mizusawa Industrial Chemicals, Ltd.): | 20 parts |
| Sodium polyacrylate: | 1 part |
| Water: | 80 parts |

A solution of thermal recording layer was obtained by mixing 60 parts of the solution A, 120 parts of the solution B, 120 parts of the solution C, 101 parts of the solution D, 15 parts of a 30% dispersion of zinc stearate, 15 parts of a paraffin wax (30%) solution, and 4 parts of sodium dodecylbenzenesulfonate (25%).

(Preparation of Coating Solution for Undercoat Layer)

Using the following component, stirring and mixing were performed by a dissolver to obtain dispersion.

| | |
|---|---|
| Calcined kaolin (oil absorbency: 75 mL/100 g): | 100 parts |
| Sodium hexametaphosphate: | 1 part |
| Distilled water: | 110 parts |

To the resulting dispersion, were added 20 parts of SBR (styrene-butadiene rubber latex) and 25 parts of oxidized starch (25%) to obtain a coating solution for undercoat layer.

(Preparation of Thermal Recording Material)

The resulting coating solution for undercoat layer was applied onto a sheet of recycled paper (basis weight: 50 g/m$^2$) composed of 70% of waste paper pulp and 30% and LBKP and having a smoothness, as defined in JIS-P8119, of 170 seconds at a coating amount (after drying) of 8 g/m$^2$ by a blade coater, to form an undercoat layer, which was then dried and subjected to calendering processing to prepare a sheet of undercoated original paper. Subsequently, the foregoing coating solution for thermal recording material was applied onto the undercoat layer at a coating amount (after drying) of 4 g/m$^2$ by a curtain coater, dried and then subjected to calendering processing to obtain a thermal recording material of Example 1.

Example 2

A thermal recording material of Example 2 was obtained in the same manner as in Example 1, except in that the amorphous silica used in the solution D of Example 1 was changed to 40 parts of cubic system calcium carbonate (trade name: BRILLIANT 15, manufactured by Shiraishi Kogyo Kaisha, Ltd., Mohs Hardness: 3).

Example 3

A thermal recording material of Example 3 was obtained in the same manner as in Example 1, except in that the amorphous silica used in the solution D of Example 1 was changed to 40 parts of aluminum hydroxide (trade name: HIGILITE H42, manufactured by Showa Denko K. K., mean particle size:1.0 μm, Mohs Hardness: 3).

Example 4

A thermal recording material of Example 4 was obtained in the same manner as in Example 1, except in that the amorphous silica used in the solution D of Example 1 was changed to 40 parts of aluminum hydroxide (trade name: C-3005, manufactured by Sumitomo Chemical Co., Ltd., mean particle size: 0.6 μm, Mohs Hardness: 3).

Example 5

A thermal recording material of Example 5 was obtained in the same manner as in Example 1, except in that the amorphous silica used in the solution D of Example 1 was changed to 40 parts of bur-shaped calcium carbonate (trade name: UNIBER 70, manufactured by Shiraishi Kogyo Kaisha, Ltd., mean particle size: 1.5 μm, Mohs Hardness: 3).

Example 6

A thermal recording material of Example 6 was obtained in the same manner as in Example 1, except in that the amorphous silica of Example 1 was changed to 30 parts of aluminum hydroxide (trade name: C-3005, manufactured by Sumitomo Chemical Co., Ltd., mean particle size: 0.6 μm, Mohs Hardness: 3) and 10 parts of basic magnesium carbonate (trade name: KINSEI, manufactured by Konoshima Chemical Kogyo Co., Ltd., mean particle size: 0.6 μm).

Example 7

A thermal recording material of Example 7 was obtained in the same manner as in Example 1, except in that the amorphous silica of Example 1 was changed to 30 parts of aluminum hydroxide (trade name: C-3005, manufactured by Sumitomo Chemical Co., Ltd., mean particle size: 0.6 μm, Mohs Hardness: 3) and 10 parts of magnesium oxide (trade name: STARMAG M, manufactured by Konoshima Chemical Kogyo Co., Ltd., mean particle size: 0.5 μm).

Example 8

A thermal recording material of Example 8 was obtained in the same manner as in Example 5, except in that the coating solution for thermal recording layer of Example 5 was applied by an air knife coater.

Comparative Example 1

A thermal recording material of Comparative Example 1 was obtained in the same manner as in Example 1, except in that the 4-hydroxybenzenesulfone anilide used in the solution B of Example 1 was changed to bisphenol A.

Comparative Example 2

A thermal recording material of Comparative Example 2 was obtained in the same manner as in Example 1, except in that the 4-hydroxybenzenesulfone anilide used in the solution B of Example 1 was changed to p-N-benzylsulfamoylphenol (i.e., N-benzyl-4-hydroxybenzene-sulfonamide) as described Example 2 of in JP-B No. 4-20792.

Referential Example 1

A thermal recording material of Referential Example 1 was obtained in the same manner as in Example 1, except in that fine quality paper composed of 50% of NBK and 50% of LBK and having a smoothness, as defined in JIS-P8119, of 170 seconds was used in place of the recycled paper of Comparative Example 1.

With respect to the thermal recording materials obtained in Examples 1 to 8, Comparative Examples 1 and 2 and Referential Example 1, the evaluation results are shown in Table 1. In Table 1, the sensitivity, background fogging, image preservability, abrasion properties of thermal head, and resistance to inkjet inks were evaluated in the following manners.

<Sensitivity>

Printing was performed using a heat-sensitive printing device having a thermal head (trade name: KJT-216-8MPD1, manufactured by Kyocera Corporation) and pressure rolls of 100 kg/cm$^2$ just before the head. The printing was carried out with a pulse width of 1.5 ms under the condition of a head voltage of 24 V and a pulse frequency of 10 ms, and its printing density was measured by a Macbeth reflection densitometer (RD-918).

<Background Fogging>

The background after being stored in an environment at 60° C. for 24 hours was measured by a Macbeth reflection densitometer (RD-918). A lower numerical value means a better result.

<Image Preservability>

The image density after being stored in an environment at 60° C. for 24 hours was measured by a Macbeth reflection densitometer (RD-918), and a retention rate to the image density of a non-treated product was calculated. A higher numerical value means better image preservability.

<Abrasion Properties of Thermal Head>

A test chart with a printing rate of 20% was printed on 1,000 A4-size sheets using a word processor (trade name: TOSHIBA RUPO JV, manufactured by Toshiba Corporation). Thereafter, the abrasion level of a serial thermal head was observed and evaluated according to the following criteria.

[Criteria]

A: Abrasion of the thermal head was not substantially observed, and white spots and the like were not found on the prints.

B: Abrasion of the thermal head was slightly observed, but white spots and the like were not found on the prints.

C: The degree of abrasion of the thermal head was large, and defects such as white spots were found on the prints.

<Resistance to Inkjet Inks>

An image obtained by high-image quality printing using an inkjet printer (trade name: MJ930C, manufactured by Seiko Epson Corporation) was brought into contact with the surface of each of the thermal recording materials as printed in the same manner as in the case of the sensitivity as described above, and after being stored at 25° C. for 48 hours, the image density was measured by a Macbeth reflection densitometer (RD-918). The image density of a non-treated product was also measured. A rate (retention rate) of the image density of the treated product to the former was calculated. A higher numerical value means better resistance against inkjet inks.

TABLE 1

| | Sensitivity | Background fogging | Image preservability | Abrasion properties of thermal head | Resistance to inkjet inks |
|---|---|---|---|---|---|
| Example 1 | 1.23 | 0.10 | 88% | B | 86% |
| Example 2 | 1.23 | 0.08 | 93% | A | 91% |
| Example 3 | 1.23 | 0.08 | 91% | A | 88% |
| Example 4 | 1.27 | 0.08 | 92% | A | 90% |
| Example 5 | 1.26 | 0.08 | 91% | A | 89% |
| Example 6 | 1.26 | 0.07 | 93% | A | 91% |
| Example 7 | 1.25 | 0.07 | 91% | A | 89% |
| Example 8 | 1.23 | 0.08 | 91% | A | 89% |
| Comparative Example 1 | 1.22 | 0.13 | 30% | B | 37% |
| Comparative Example 2 | 1.10 | 0.10 | 65% | B | 70% |
| Referential Example 1 | 1.22 | 0.10 | 70% | B | 50% |

As clearly shown by the results in Table 1, the thermal recording materials obtained in the Examples of the invention were a thermal recording material that was superior in sensitivity, background fogging and storage stability of color-developed images, while using recycled paper composed mainly of waste paper pulp as the support. Further, the thermal recording materials of Examples 1 to 8 were low in abrasion of thermal head and superior in resistance to inkjet inks.

On the other hand, when bisphenol A was used as the color developer and recycled paper was used as the support, the background fogging and image preservability were remarkably inferior, and abrasion of the thermal head was observed. Further, in Comparative Example 2 using a sulfonamide compound different from the sulfonamide compound of the invention, not only the sensitivity, background fogging and image preservability were inferior, but also abrasion of the thermal head was observed. Moreover, even when fine quality paper was used as the support, in a case bisphenol A was used as the color developer, the sensitivity and image preservability were inferior, and abrasion of the thermal head was observed. In addition, the thermal recording materials of Comparative Examples 1 and 2 and Referential Example 1 were inferior in resistance to inkjet inks.

Example 9

(Preparation of Coating Solution for Heat-sensitive Color-developing Layer)

<Preparation of Solution E (Electron-donating Colorless Dye)>

Using the following composition, dispersion having a mean particle size of 0.8 μm was obtained by a ball mill.

| | |
|---|---|
| 2-Anilino-3-methyl-6-di-n-butylaminofluorane: | 10 parts |
| 2.5% solution of polyvinyl alcohol (trade name: PVA-105 (degree of hydrolysis: 98.5% by mole, degree of polymerization: 500), manufactured by Kuraray Co., Ltd.): | 50 parts |

<Preparation of Solution F (Electron-accepting Compound)>

Using the following composition, dispersion having a mean particle size of 0.8 μm was obtained by a ball mill.

| | |
|---|---|
| 4-Hydroxybenzenesulfone anilide: | 20 parts |
| 2.5% solution of polyvinyl alcohol (trade name: PVA-105): | 100 parts |

<Preparation of Solution G (Sensitizer)>

Using the following composition, dispersion having a mean particle size of 0.8 μm was obtained by a sand mill.

| | |
|---|---|
| 2-Benzyloxynaphthalene: | 20 parts |
| 2.5% solution of polyvinyl alcohol (trade name: PVA-105): | 100 parts |

<Preparation of Solution H (Pigment)>

Using the following composition, a pigment dispersion having a mean particle size of 2.0 μm was obtained by a ball mill.

| | |
|---|---|
| Calcium carbonate (trade name: UNIBER 70, manufactured by Shiraishi Kogyo Kaisha, Ltd.): | 20 parts |

-continued

| | |
|---|---|
| Sodium polyacrylate: | 1 part |
| Water: | 80 parts |

A solution of thermal recording layer was obtained by mixing 60 parts of the solution E, 120 parts of the solution F, 120 parts of the solution G, 101 parts of the solution H, 15 parts of a 30% dispersion of zinc stearate, 15 parts of a paraffin wax (30%) solution, and 4 parts of sodium dodecylbenzenesulfonate (25%).

(Preparation of Coating Solution for Undercoat Layer)

Using the following component, stirring and mixing were performed by a dissolver to obtain dispersion.

| | |
|---|---|
| Calcined kaolin (oil absorbency: 75 mL/100 g): | 100 parts |
| Sodium hexametaphosphate: | 1 part |
| Water: | 110 parts |

To the resulting dispersion, were added 20 parts of SBR (styrene-butadiene rubber latex) and 25 parts of oxidized starch (25%) to obtain a coating solution for undercoat layer of support.

(Preparation of Thermal Recording Material)

The resulting coating solution for undercoat layer was applied onto a sheet of recycled paper (basis weight: 50 g/m$^2$) composed of 70% of waste paper pulp and 30% of LBKP and having a paper surface pH, as measured using a pH indicator for paper surface measurement (manufactured by Kyoritsu Chemical-Check Lab., Corp.), of 6 and having a smoothness, as defined in JIS-P8119, of 170 seconds at a coating amount (after drying) of 8 g/m$^2$ by a blade coater, to form an undercoat layer, which was then dried and subjected to calendering processing to prepare a sheet of undercoated original paper. Subsequently, the foregoing coating solution for thermal recording material was applied onto the undercoat layer at a coating amount (after drying) of 4 g/m$^2$ by a curtain coater, dried and then subjected to calendering processing to obtain a thermal recording material of Example 9.

Example 10

A thermal recording material of Example 10 was obtained in the same manner as in Example 9, except in that the electron-donating dye (2-anilino-3-methyl-6-di-n-butylaminofluorane) used in the solution E of Example 9 was changed to 2-anilino-3-methyl-6-di-n-amylaminofluorane (BLACK 305).

Example 11

A thermal recording material of Example 11 was obtained in the same manner as in Example 9, except in that the electron-donating dye (2-anilino-3-methyl-6-di-n-butylaminofluorane) used in the solution E of Example 9 was changed to 2-anilino-3-methyl-6-(N-ethyl-N-p-benzyl)aminofluorane.

Example 12

A thermal recording material of Example 12 was obtained in the same manner as in Example 9, except in that the recycled paper having a pH of 6 as used in Example 9 was changed to recycled paper having a pH of 9.

Examples 13

A thermal recording material of Example 13 was obtained in the same manner as in Example 9, except in that the recycled paper having a pH of 6 as used in Example 9 was changed to recycled paper having a pH of 5.

Example 14

A thermal recording material of Example 14 was obtained in the same manner as in Example 9, except in that the recycled paper having a pH of 6 as used in Example 9 was changed to recycled paper having a pH of 10.

Comparative Example 3

A thermal recording material of Comparative Example 3 was obtained in the same manner as in Example 9, except in that the 4-hydroxybenzenesulfone anilide used as the electron-accepting compound in the solution F of Example 9 was changed to bisphenol A.

Comparative Example 4

A thermal recording material of Comparative Example 4 was obtained in the same manner as in Example 9, except in that the 4-hydroxybenzenesulfone anilide used as the electron-accepting compound in the solution F of Example 9 was changed to N-benzyl-4-hydroxybenzenesulfonamide.

Comparative Example 5

A thermal recording material of Comparative Example 5 was obtained in the same manner as in Example 9, except in that the 2-anilino-3-methyl-6-di-n-butylaminofluorane used as the electron-donating colorless dye in the solution E of Example 9 was changed to 2-anilino-3-methyl-6-(N-cyclohexyl-N-methyl)aminofluorane.

Comparative Example 6

A thermal recording material of Comparative Example 6 was obtained in the same manner as in Example 9, except in that the 2-anilino-3-methyl-6-di-n-butylaminofluorane used as the electron-donating colorless dye in the solution E of Example 9 was changed to 3-dimethylamino-6-methyl-7-(m-toluidino)-fluorane.

Comparative Example 7

A thermal recording material of Comparative Example 7 was obtained in the same manner as in Example 9, except in that fine quality paper composed of 50% of NBKP and 50% of LBKP and having a paper surface pH, as measured using a pH indicator for paper surface measurement (manufactured by Kyoritsu Chemical-Check Lab., Corp.), of 6 and having a smoothness, as defined in JIS-P8119, of 170 seconds was used in place of the recycled paper composed of 70% of waste paper pulp and 30% of LBKP and having a paper surface pH, as measured using a pH indicator for paper surface measurement (manufactured by Kyoritsu Chemical-Check Lab., Corp.), of 6 and having a smoothness, as defined in JIS-P8119, of 170 seconds as used in Comparative Example 3.

With respect to the thermal recording materials obtained in Examples 9 to 14 and Comparative Examples 3 to 7, the evaluation results are shown in Table 2. In Table 2, the sensitivity, background fogging, image preservability, chemical resistance, and adaptability to inkjet printing were evaluated in the following manners.

<Sensitivity>

Printing was performed using a heat-sensitive printing device having a thermal head (trade name: KJT-216-8MPD1, manufactured by Kyocera Corporation) and pressure rolls of 100 kg/cm$^2$ just before the head. The printing was carried out with a pulse width of 1.5 ms under the condition of a head voltage of 24 V and a pulse frequency of 10 ms, and its printing density was measured by a Macbeth reflection densitometer (RD-918).

<Background Fogging>

The background after being stored in an environment at 60° C. for 24 hours was measured by a Macbeth reflection densitometer (RD-918). A lower numerical value means a better result.

<Image Preservability>

The image density after being stored in an environment at 60° C. for 24 hours was measured by a Macbeth reflection densitometer (RD-918), and a retention rate to the image density of a non-treated product was calculated. A higher numerical value means better image preservability.

<Chemical Resistance>

Each of the thermal recording materials was printed under the same condition as in the case of the sensitivity as described above, and writing was made on the surfaces of the background and printed portions thereof using a fluorescent pen (trade name: ZEBRA FLUORESCENT PEN 2-PINK, manufactured by Zebra Co., Ltd.). One day after writing, the state of generation of the background fogging and the stability of the image portions of the thermal recording material were visually observed and evaluated according to the following criteria.

[Criteria]

A: The generation of fogging was not observed, and the change of the image portions was not observed.

B: The generation of fogging was slightly observed, and the image portions slightly faded.

C: The generation of fogging was remarkably observed, and the image portions substantially faded.

<Evaluation of Adaptability to Inkjet Inks>

Each of the thermal recording materials was printed with red letters in a superfine mode using an inkjet printer (trade name: MJ930, manufactured by Seiko Epson Corporation) and evaluated for the color (fogging) of the letters according to the following criteria.

[Criteria]

TABLE 2

| | Sensitivity | Background fogging | Image preservability | Chemical resistance | Adaptability to inkjet printing |
|---|---|---|---|---|---|
| Example 9 | 1.32 | 0.06 | 90% | A | A |
| Example 10 | 1.33 | 0.06 | 89% | A | A |
| Example 11 | 1.30 | 0.06 | 90% | A | A |
| Example 12 | 1.34 | 0.07 | 89% | A | A |
| Example 13 | 1.36 | 0.09 | 92% | A | A |
| Example 14 | 1.26 | 0.06 | 87% | A | A |

TABLE 2-continued

| | Sensitivity | Background fogging | Image preservability | Chemical resistance | Adaptability to inkjet printing |
|---|---|---|---|---|---|
| Comparative Example 3 | 1.21 | 0.13 | 70% | C | C |
| Comparative Example 4 | 1.15 | 0.10 | 60% | A | C |
| Comparative Example 5 | 1.16 | 0.12 | 92% | A | A |
| Comparative Example 6 | 1.15 | 0.12 | 91% | A | A |
| Comparative Example 7 | 1.31 | 0.06 | 89% | A | A |

A: Vivid red
B: Dull red
C: Black rather than red

As clearly shown by the results in Table 2, the thermal recording materials obtained in the Examples of the invention were a thermal recording material that is superior in sensitivity, background fogging and storage stability of color-developed images, while using recycled paper composed mainly of waste paper pulp. Further, the thermal recording materials of Examples 9 to 14 were superior in any of chemical resistance and adaptability to inkjet printing (inkjet fogging).

On the other hand, when bisphenol A was used as the color developer and recycled paper was used as the support, the background fogging and image preservability were remarkably inferior, and the chemical resistance and adaptability to inkjet printing were inferior. Further, in Comparative Example 4 using a sulfonamide compound different from the sulfonamide compound of the invention, not only the sensitivity, background fogging and image preservability were inferior, but also the inkjet fogging was observed. Moreover, the thermal recording materials obtained in Comparative Examples 5 and 6 not using any of 2-anilino-3-methyl-6-di-n-butylaminofluorane, 2-anilino-3-methyl-6-di-n-amylaminofluorane, and 2-anilino-3-methyl-6-(N-ethyl-N-p-benzyl)aminofluorane as the electron-donating colorless dye were remarkably inferior in background fogging.

In addition, the thermal recording materials of the invention using recycled paper as the support stood comparison in any of the check items even with the thermal recording material of Referential Example 1 using fine quality paper as the support.

Example 15

<<Formation of Thermal Recording Material>>

<Preparation of Coating Solution for Heat-sensitive Color-developing Layer>

(Preparation of Dispersion I)

The following respective components were mixed in a sand mill while dispersing to obtain dispersion I having a mean particle size of 0.6 μm.

[Composition of Dispersion I]

| | |
|---|---|
| 2-Anilino-3-methyl-6-diethylaminofluorane (electron-donating colorless dye): | 10 parts |
| 2.5% solution of polyvinyl alcohol (trade name: PVA-105, manufactured by Kuraray Co., Ltd.): | 50 parts |

(Preparation of Dispersion J)

The following respective components were mixed in a sand mill while dispersing to obtain dispersion J having a mean particle size of 0.6 μm.

[Composition of Dispersion J]

| | |
|---|---|
| 4-Hydroxybenzenesulfone anilide (electron-accepting compound): | 25 parts |
| 2.5% solution of polyvinyl alcohol (trade name: PVA-105, manufactured by Kuraray Co., Ltd.): | 100 parts |

(Preparation of Dispersion K)

The following respective components were mixed in a sand mill while dispersing to obtain dispersion K having a mean particle size of 0.6 μm.

[Composition of Dispersion K]

| | |
|---|---|
| 2-Benzyloxynaphthalene (sensitizer): | 25 parts |
| 2.5% solution of polyvinyl alcohol (trade name: PVA-105, manufactured by Kuraray Co., Ltd.): | 100 parts |

(Preparation of Pigment Dispersion L)

The following respective components were mixed in a sand mill while dispersing to obtain a pigment dispersion L having a mean particle size of 1.2 μm.

[Composition of Pigment Dispersion L]

| | |
|---|---|
| Light calcium carbonate of calcite type (trade name: UNIBER 70, manufactured by Shiraishi Kogyo Kaisha, Ltd.): | 30 parts |
| Sodium hexametaphosphate: | 0.3 parts |
| Distilled water: | 40 parts |

The compounds having the following composition were mixed to obtain a coating solution for heat-sensitive color-developing layer.

[Composition of Coating Solution for Heat-sensitive Color-developing Layer]

| | |
|---|---|
| Dispersion I: | 60 parts |
| Dispersion J: | 125 parts |
| Dispersion K: | 125 parts |
| Pigment dispersion L: | 70 parts |
| 30% dispersion of zinc stearate: | 15 parts |
| Paraffin wax (30%): | 15 parts |
| Sodium dodecylbenzenesulfonate (25%): | 4 parts |

(Preparation of Coating Solution for Undercoat Layer of Support)

The following respective components were stirred and mixed by a dissolver, to which were then added 20 parts of SBR (styrene-butadiene rubber latex) and 25 parts of oxidized starch (25%) to obtain a coating solution for undercoat layer of support.

[Composition of Coating Solution for Undercoat Layer of Support]

| | |
|---|---|
| Calcined kaolin (oil absorbency: 75 mL/100 g): | 100 parts |
| Sodium hexametaphosphate: | 1 part |
| Distilled water: | 110 parts |

<Preparation of Thermal Recording Material>

The thus obtained coating solution for undercoat layer of support was applied onto a sheet of fine quality original paper having a Stoeckigt size of 10 seconds and a basis weight of 50 g/m$^2$ at a coating amount (after drying) of 8 g/m$^2$ by a blade coater, dried and then subjected to calendering processing, to prepare an undercoat layer. Subsequently, the foregoing coating solution for thermal recording material was applied onto the undercoat layer at a coating amount (after drying) of 4 g/m$^2$ by a curtain coater, followed by drying. The surface of the thus formed heat-sensitive color-developing layer was subjected to calendering processing to obtain a thermal recording material of Example 15.

Example 16

A thermal recording material according to Example 16 was prepared in the same manner as in Example 15, except in that the light calcium carbonate of calcite type (UNIBER 70) of the pigment dispersion L in Example 15 was changed to calcium carbonate of calcite type (trade name: TAMA PEARL 121, manufactured by Okutama Kogyo Co., Ltd.).

Example 17

A thermal recording material according to Example 17 was prepared in the same manner as in Example 15, except in that the light calcium carbonate of calcite type (UNIBER 70) of the pigment dispersion L in Example 15 was changed to aluminum hydroxide (trade name: HIGILITE H42, manufactured by Showa Denko K.K.).

Example 18

A thermal recording material according to Example 18 was prepared in the same manner as in Example 15, except in that the amount of the pigment dispersion L in Example 15 was changed from 70 parts to 35 parts.

Example 19

A thermal recording material according to Example 19 was prepared in the same manner as in Example 15, except in that the amount of the pigment dispersion L in Example 15 was changed from 70 parts to 140 parts.

Example 20

A thermal recording material according to Example 20 was prepared in the same manner as in Example 15, except in that the amount of the pigment dispersion L in Example 15 was changed from 70 parts to 17.5 parts.

Example 21

A thermal recording material according to Example 21 was prepared in the same manner as in Example 15, except in that the amount of the pigment dispersion L in Example 15 was changed from 70 parts to 210 parts.

Example 22

A thermal recording material according to Example 22 was prepared in the same manner as in Example 15, except in that the mean particle size of the dispersion L in Example 15 was changed from 1.2 μm to 2.2 μm.

Example 23

A thermal recording material according to Example 23 was prepared in the same manner as in Example 15, except in that the mean particle size of the dispersion L in Example 15 was changed from 1.2 μm to 0.8 μm.

Example 24

A thermal recording material according to Example 24 was prepared in the same manner as in Example 15, except in that the mean particle size of the dispersion L in Example 15 was changed from 1.2 μm to 0.5 μm.

Example 25

A thermal recording material according to Example 25 was prepared in the same manner as in Example 15, except in that the mean particle size of the dispersion L in Example 15 was changed from 1.2 μm to 3.0 μm.

Example 26

A thermal recording material according to Example 26 was prepared in the same manner as in Example 15, except in that in Example 15, the following coating solution for undercoat layer of support was applied onto a sheet of fine quality original paper having a Stoeckigt size of 10 seconds and a basis weight of 50 g/m$^2$ at a coating amount (after drying) of 8 g/m$^2$ by an air knife coater in place of the blade coater, dried and then subjected to calendering processing, to prepare a sheet of undercoated original paper.

(Preparation of Coating Solution for Undercoat Layer of Support)

The following respective components were stirred and mixed by a dissolver, to which were then added 20 parts of SBR (styrene-butadiene rubber latex) and 25 parts of oxidized starch (25%) to obtain a coating solution for undercoat layer of support.

[Composition of Coating Solution for Undercoat Layer of Support]

| | |
|---|---|
| Calcined kaolin (oil absorbency: 75 mL/100 g): | 100 parts |
| Sodium hexametaphosphate: | 1 part |
| Distilled water: | 314 parts |

Example 27

A thermal recording material according to Example 27 was prepared in the same manner as in Example 15, except in that in Example 15, the coating solution for thermal recording material was applied onto the undercoat layer by an air knife coater in place of the curtain coater.

Example 28

A thermal recording material according to Example 28 was prepared in the same manner as in Example 15, except in that the light calcium carbonate of calcite type (UNIBER 70) of the pigment dispersion L in Example 15 was changed to kaolin (trade name: KAOGLOSS, manufactured by Shiraishi Calcium Kaisha, Ltd.).

Example 29

A thermal recording material according to Example 29 was prepared in the same manner as in Example 15, except in that in Example 15, before subjecting the formed heat-sensitive color-developing layer to calendering processing, the following coating solution for protective layer was further applied onto the heat-sensitive color-developing layer at a coating amount (after drying) of 2 g/m$^2$ by a curtain coater and then dried to form a protective layer, followed by subjecting the surface of the protective layer to calendering processing.

(Preparation of Coating Solution for Protective Layer)

First of all, the following composition was dispersed in a sand mill to obtain a pigment dispersion having a mean particle size of 2 μm. Subsequently, 60 parts of water was added to 200 parts of a 15% aqueous solution of urea phosphated starch (trade name: MS4600, manufactured by Nihon Shokuhinkako Co., Ltd.) and 200 parts of a 15% aqueous solution of polyvinyl alcohol (trade name: PVA-105, manufactured by Kuraray Co., Ltd.), with which was then mixed the foregoing pigment dispersion. The mixture was further mixed with 25 parts of an emulsified dispersion of zinc stearate having a mean particle size of 0.15 μm (trade name: HYDRIN F115, manufactured by Chukyo Yushi Co., Ltd.) and 125 parts of a 2% aqueous solution of 2-ethylhexyl sulfosuccinate sodium salt, to obtain a coating solution for protective layer.

[Composition of Coating Solution for Protective Layer]

| | |
|---|---|
| Aluminum hydroxide (mean particle size: 1 μm) (trade name: HIGILITE H42, manufactured by Showa Denko K.K.): | 40 parts |
| Sodium polyacrylate: | 1 part |
| Water: | 60 parts |

Example 30

A thermal recording material according to Example 30 was prepared in the same manner as in Example 15, except in that the light calcium carbonate of calcite type (UNIBER 70) of the pigment dispersion L in Example 15 was changed to amorphous silica (trade name: MIZUKASIL P78A, manufactured by Mizusawa Industrial Chemicals, Ltd.).

Example 31

A thermal recording material according to Example 31 was prepared in the same manner as in Example 30, except in that in Example 30, 30 parts of polyamine polyamide epichlorohydrin (trade name: ARAFIX 2300, manufactured by Arakawa Chemical Industries, Ltd.) was added.

Comparative Example 8

A thermal recording material according to Comparative Example 8 was prepared in the same manner as in Example 15, except in that the light calcium carbonate of calcite type (UNIBER 70) of the pigment dispersion L in Example 15 was changed to aragonite-based calcium carbonate (trade name: CALLITE SA, manufactured by Shiraishi Kogyo Kaisha, Ltd.).

Comparative Example 9

A thermal recording material according to Comparative Example 9 was prepared in the same manner as in Example 15, except in that the 4-hydroxybenzenesulfone anilide of the dispersion J in Example 15 was changed to 2,2-bis(4-hydroxyphenyl)propane [bisphenol A].

Comparative Example 10

A thermal recording material according to Comparative Example 10 was prepared in the same manner as in Example 15, except in that the 4-hydroxybenzenesulfone anilide of the dispersion J in Example 15 was changed to N-benzyl-4-hydroxybenzenesulfonamide (i.e., p-N-benzylsulfamoylphenol).

<<Evaluation>>

(1) Sensitivity:

Each of the thermal recording materials obtained in the foregoing Examples 15 to 31 and Comparative Examples 8 to 10 was printed using a thermosensitive printing device having a thermal head (trade name: KJT-216-8MPD1, manufactured by Kyocera Corporation) and pressure rolls of 100 kg/cm$^2$ just before the head. The printing was carried out with a pulse width of 1.5 ms under the condition of a head voltage of 24 V and a pulse frequency of 10 ms, and its printing density was measured by a Macbeth reflection densitometer (RD-918). The results are shown in Table 3.

(2) Background Fogging:

With respect to each of the thermal recording materials obtained in the foregoing Examples 15 to 31 and Comparative Examples 8 to 10, the background after being stored in an environment at 60° C. and at a relative humidity of 20% for 24 hours was measured by a Macbeth reflection densitometer (RD-918). The results are shown in Table 3. A lower numerical value means a better result.

(3) Image Preservability:

Each of the thermal recording materials obtained in the foregoing Examples 15 to 31 and Comparative Examples 8 to 10 was recorded with an image using the same device and under the same condition as in (1) above, and then stored in an environment at 60° C. and at a relative humidity of 20% for 24 hours. Thereafter, the image density was measured by a Macbeth reflection densitometer (RD-918), and a retention rate to the image density of a non-treated product on which an image had been recorded using the same device and under the same condition as in (1) above was calculated by the following equation. The results are shown in Table 3. A higher numerical value means better image preservability.

Image retention rate (%)=[(Image density after being stored under the foregoing condition)/(Image density immediately after printing)]×100

(4) Chemical Resistance:

On the surface of each of the thermal recording materials obtained in the foregoing Examples 15 to 31 and Comparative Examples 8 to 10, writing was made using a fluorescent pen (trade name: ZEBRA FLUORESCENT PEN 2-PINK, manufactured by Zebra Co., Ltd.). One day after writing, the state of generation of the background fogging and the stability of the image portions of each thermal recording material were visually observed and evaluated according to the following criteria.

[Criteria]

A: The generation of fogging was not observed, and the change of the image portions was not observed.

B: The generation of fogging was slightly observed, and the image portions slightly faded.

C: The generation of fogging was remarkably observed, and the image portions substantially faded.

(5) Adhesion of Scum to Thermal Head:

About 100 m of each of the thermal recording materials obtained in the foregoing Examples 15 to 31 and Comparative Examples 8 to 10 was printed using a facsimile machine (trade name: SFX 85, manufactured by Sanyo Electric co., Ltd.) and No. 3 Chart of The Imaging Society of Japan as a test chart. Thereafter, the state of adhesion of scum to thermal head was observed and evaluated according to the following criteria. The results are shown in Table 3.

[Criteria]

A: Adhesion of scum was not observed, and white spots and the like were not found on the prints.

B: An adhesion amount of scum was slight, and white spots and the like were not found on the prints.

C: An adhesion amount of scum was medium, and white spots and the like were not found on the prints.

D: An adhesion amount of scum was large, and defects such as white spots were found on the prints.

(6) Abrasion Properties of Thermal Head:

With respect to each of the thermal recording materials obtained in the foregoing Examples 15 to 31 and Comparative Examples 8 to 10, a test chart with a printing rate of 20% was printed on 1,000 A4-size sheets using a word processor (trade name: TOSHIBA RUPO JV, manufactured by Toshiba Corporation). Thereafter, the abrasion level of a serial thermal head was observed and evaluated according to the following criteria. The results are shown in Table 3.

[Criteria]

A: Abrasion of the thermal head was not observed, and white spots and the like were not found on the prints.

B: Abrasion of the thermal head was not substantially observed, and white spots and the like were not found on the prints.

C: Abrasion of the thermal head was slightly observed, but white spots and the like were not found on the prints.

D: The degree of abrasion of the thermal head was large, and defects such as white spots were found on the prints.

(7) Adaptability of Inkjet Recording:

A sheet on which letters had been printed using a word processor (trade name: TOSHIBA RUPO JW-95JU, manufactured by Toshiba Corporation) was printed by an inkjet printer, and bleeding of the inkjet recording and fading of the letters recorded by the word processor were visually evaluated according to the following criteria.

[Criteria]

A: Bleeding and fading were not observed, and there was no problem in reading.

B: The letters became slightly pale, but there was no problem in reading.

C: The letters became faint, but could be read.

D: The letters completely faded and were illegible.

(8) Resistance to Inkjet Inks:

An image obtained by high-image quality printing using an inkjet printer (trade name: MJ930C, manufactured by Seiko Epson Corporation) was brought into contact with the surface of each of the thermal recording materials as printed in the same manner as in the case of the sensitivity as described above, and after being stored at 25° C. for 48 hours, the image density was measured by a Macbeth reflection densitometer (RD-918). The image density of a non-treated product was also measured. A rate (retention rate) of the image density of the treated product to the former was calculated. A higher numerical value means better resistance against inkjet inks.

TABLE 3

| | Image | | | | | | Inkjet | |
|---|---|---|---|---|---|---|---|---|
| | Sensitivity | Background fogging | preservability (%) | Chemical resistance | Head scum | Head abrasion | Adaptability to recording | Resistance to inks (%) |
| Example 15 | 1.31 | 0.09 | 93 | A | B | B | B | 90 |
| Example 16 | 1.3 | 0.09 | 91 | A | B | B | B | 89 |
| Example 17 | 1.32 | 0.10 | 88 | A | B | B | B | 85 |
| Example 18 | 1.32 | 0.09 | 92 | A | B | B | B | 90 |
| Example 19 | 1.29 | 0.08 | 87 | A | B | B | B | 89 |
| Example 20 | 1.31 | 0.10 | 88 | A | C | B | B | 85 |
| Example 21 | 1.28 | 0.09 | 84 | A | B | B | B | 80 |
| Example 22 | 1.29 | 0.09 | 88 | A | B | B | B | 85 |
| Example 23 | 1.31 | 0.09 | 89 | A | C | B | B | 84 |
| Example 24 | 1.31 | 0.10 | 86 | A | C | B | B | 82 |
| Example 25 | 1.28 | 0.09 | 83 | A | B | B | B | 80 |
| Example 26 | 1.27 | 0.09 | 73 | A | B | B | B | 70 |
| Example 27 | 1.28 | 0.10 | 84 | A | C | B | B | 80 |
| Example 28 | 1.24 | 0.11 | 82 | A | C | B | B | 78 |
| Example 29 | 1.26 | 0.10 | 98 | A | A | B | B | 95 |
| Example 30 | 1.27 | 0.09 | 93 | A | B | B | A | 90 |
| Example 31 | 1.25 | 0.09 | 94 | A | B | B | A | 91 |
| Comparative Example 8 | 1.24 | 0.11 | 82 | A | B | D | B | 88 |
| Comparative Example 9 | 1.22 | 0.10 | 70 | C | B | B | B | 40 |
| Comparative Example 10 | 1.16 | 0.10 | 60 | A | B | B | B | 70 |

As shown in Table 3, the thermal recording materials according to Examples 15 to 31 were good in each of sensitivity, background fogging, image preservability, chemical resistance, adhesion of scum to head, and head abrasion. In particular the thermal recording materials in which the amount of the inorganic pigment to be used was from 50 to 250% on a basis of the electron-accepting compound was more superior in the foregoing performances. Further, in comparison between Example 15 and Example 26, when the undercoat layer was applied using the blade coater, the image stability was superior.

On the other hand, the thermal recording materials according to Comparative Examples 8 to 10 were inferior in any one of the foregoing performances. Especially, when bisphenol A was used as the electron-accepting compound, the image preservability was extremely low.

Example 32

<<Formation of Thermal Recording Material>>

<Preparation of Coating Solution for Heat-sensitive Color-developing Layer>

(Preparation of Dispersion M (Electron-donating Colorless Dye))

The following respective components were mixed in a ball mill while dispersing to obtain dispersion M having a mean particle size of 0.7 μm.

[Composition of Dispersion M]

| | |
|---|---|
| 2-Anilino-3-methyl-6-di-n-butylaminofluorane: | 10 parts |
| 2.5% solution of polyvinyl alcohol (trade name: PVA-105, manufactured by Kuraray Co., Ltd.): | 50 parts |

(Preparation of Dispersion N (Electron-Accepting Compound))

The following respective components were mixed in a ball mill while dispersing to obtain dispersion N having a mean particle size of 0.7 μm.

[Composition of Dispersion N]

| | |
|---|---|
| 4-Hydroxybenzenesulfone anilide: | 20 parts |
| 2.5% solution of polyvinyl alcohol (trade name: PVA-105, manufactured by Kuraray Co., Ltd.): | 100 parts |

(Preparation of Dispersion O (Sensitizer))

The following respective components were mixed in a ball mill while dispersing to obtain dispersion O having a mean particle size of 0.7 μm.

[Composition of Dispersion O]

| | |
|---|---|
| 2-Benzyloxynaphthalene (sensitizer): | 20 parts |
| 2.5% solution of polyvinyl alcohol (trade name: PVA-105, manufactured by Kuraray Co., Ltd.): | 100 parts |

(Preparation of Pigment Dispersion P)

The following respective components were mixed in a sand mill while dispersing to obtain a pigment dispersion P having a mean particle size of 2.0 μm and a pH of 9.5.

[Composition of Pigment Dispersion P]

| | |
|---|---|
| Light calcium carbonate: | 40 parts |
| Sodium polyacrylate: | 1 part |
| Water: | 60 parts |

The compounds having the following composition were mixed to obtain a coating solution for heat-sensitive color-developing layer.

[Composition of Coating Solution for Heat-sensitive Color-developing Layer]

| | |
|---|---|
| Dispersion M: | 60 parts |
| Dispersion N: | 120 parts |
| Dispersion O: | 120 parts |
| Pigment dispersion P: | 101 parts |
| 30% dispersion of zinc stearate: | 15 parts |
| Paraffin wax (30%): | 15 parts |
| Sodium dodecylbenzenesulfonate (25%): | 4 parts |

(Preparation of Coating Solution for Undercoat Layer of Support)

The following respective components were stirred and mixed by a dissolver to obtain dispersion.

| | |
|---|---|
| Calcined kaolin (oil absorbency: 75 mL/100 g): | 100 parts |
| Sodium hexametaphosphate: | 1 part |
| Water: | 110 parts |

To the resulting dispersion were added 20 parts of SBR (styrene-butadiene rubber latex) and 25 parts of oxidized starch (25%) to obtain a coating solution for undercoat layer of support.

<Preparation of Thermal Recording Material>

The thus obtained coating solution for undercoat layer of support was applied onto a sheet of fine quality paper having a smoothness according to JIS-P8119 of 150 seconds at a coating amount (after drying) of 8 g/m$^2$ by a blade coater, to form an undercoat layer. By providing the undercoat layer, the support had a smoothness according to JIS-P8119 of 350 seconds. Subsequently, the foregoing coating solution for thermal recording material was applied onto the undercoat layer at a coating amount (after drying) of 4 g/m$^2$ by a curtain coater, followed by drying. The surface of the thus formed heat-sensitive color-developing layer was subjected to calendering processing to obtain a thermal recording material of Example 32.

Example 33

A thermal recording material of Example 33 was prepared in the same manner as in Example 32, except in that the 2-anilino-3-methyl-6-di-n-butyalminofluorane of the composition of the dispersion M in Example 32 was changed to 2-anilino-3-methyl-6-di-n-amylaminofluorane.

Example 34

A thermal recording material of Example 34 was prepared in the same manner as in Example 32, except in that the 2-anilino-3-methyl-6-di-n-butyalminofluorane of the composition of the dispersion M in Example 32 was changed to 2-anilino-3-methyl-6-(N-ethyl-N-p-benzyl)aminofluorane.

Example 35

A thermal recording material of Example 35 was prepared in the same manner as in Example 32, except in that the light calcium carbonate of the composition of the pigment dispersion P in Example 32 was changed to aluminum hydroxide (trade name: HIGILITE H42, manufactured by Showa Denko K.K.) and that the pH of the dispersion was changed to 9.1.

Example 36

A thermal recording material of Example 36 was prepared in the same manner as in Example 32, except in that the light calcium carbonate of the composition of the pigment dispersion P in Example 32 was changed to kaolin (trade name: KAOGLOSS, manufactured by Shiraishi Calcium Kaisha, Ltd.) and that the pH of the dispersion was changed to 7.

Example 37

A thermal recording material of Example 37 was prepared in the same manner as in Example 32, except in that the light calcium carbonate of the composition of the pigment dispersion P in Example 32 was changed to silica (trade name: MIZUKASIL P526, manufactured by Mizusawa Industrial Chemicals, Ltd.) and that the pH of the dispersion was changed to 6.5.

Comparative Example 11

A thermal recording material of Comparative Example 11 was prepared in the same manner as in Example 32, except in that the 4-hydroxybenzenesulfone anilide of the composition of the dispersion N in Example 32 was changed to bisphenol A.

Comparative Example 12

A thermal recording material of Comparative Example 12 was prepared in the same manner as in Example 32, except in that the 4-hydroxybenzenesulfone anilide of the composition of the dispersion N in Example 32 was changed to N-benzyl-4-hydroxybenzenesulfonamide.

Comparative Example 13

A thermal recording material of Comparative Example 13 was prepared in the same manner as in Example 32, except in that the 2-anilino-3-methyl-6-di-n-butylaminofluorane of the composition of the dispersion M in Example 32 was changed to 2-anilino-3-methyl-6-(N-cyclohexyl-N-methyl) aminofluorane.

Comparative Example 14

A thermal recording material of Comparative Example 14 was prepared in the same manner as in Example 32, except in that the 2-anilino-3-methyl-6-di-n-butylaminofluorane of the composition of the dispersion M in Example 32 was changed to 3-dimethylamino-6-meth-yl-7-(m-toluidino)-fluorane.

Comparative Example 15

A thermal recording material of Comparative Example 15 was prepared in the same manner as in Example 32, except in that the light calcium carbonate of the composition of the pigment dispersion P in Example 32 was not used.

<<Evaluation of Thermal Recording Material>>

Each of the thermal recording materials prepared in Examples 32 to 37 and Comparative Examples 11 to 15 was evaluated in terms of the following items.

(1) Sensitivity:

Printing was performed using a thermosensitive printing device having a thermal head (trade name: KJT-216-8MPD1, manufactured by Kyocera Corporation). The printing was carried out with a pulse width of 1.5 ms under the condition of a head voltage of 24 V and a pulse frequency of 10 ms, and its printing density was measured by a Macbeth reflection densitometer (RD-918). The results are shown in Table 4.

(2) Background Fogging:

With respect to each of the thermal recording materials, its background after being stored in an environment at 60° C. and at a relative humidity of 20% for 24 hours was measured by a Macbeth reflection densitometer (RD-918). The results are shown in Table 4. A lower numerical value means a better result.

(3) Image Preservability:

With respect to each of the thermal recording materials, an image was recorded using the same device and under the same condition as in (1) above, and then stored in an atmosphere at 60° C. and at a relative humidity of 20% for 24 hours. Thereafter, the image density was measured by a Macbeth reflection densitometer (RD-918). A rate (image retention rate) of the image density to the image density immediately after printing under the same condition (1) above was calculated by the following equation. The results are shown in Table 4. A higher numerical value means better image preservability.

Image retention rate=[(Image density after being stored under the foregoing condition)/(Image density immediately after printing)]×100

(4) Chemical Resistance:

Each of the thermal recording materials was printed under the same condition as in (1) above, and writing was made on the surfaces of the background and printed portions thereof using a fluorescent pen (trade name: ZEBRA FLUORESCENT PEN 2-PINK, manufactured by Zebra Co., Ltd.). One day after writing, the state of generation of the background fogging and the stability of the image portions of the thermal recording material were visually observed and evaluated according to the following criteria. The results are shown in Table 4.

[Criteria]

A: The generation of fogging was not observed, and the change of the image portions was not observed.

B: The generation of fogging was slightly observed, and the image portions slightly faded.

C: The generation of fogging was remarkably observed, and the image portions substantially faded.

(5) Evaluation of Adaptability to Inkjet Printing:

Each of the thermal recording materials was printed with red letters in a superfine mode using an inkjet printer (trade name: MJ930, manufactured by Seiko Epson Corporation) and evaluated for the color (fogging) of the letters according to the following criteria.

A: Vivid red

B: Dull red

C: Black rather than red (6) Adhesion of Scum to Thermal Head:

About 100 m of each of the thermal recording materials obtained in the foregoing Examples 32 to 37 and Comparative Examples 11 to 15 was printed using a facsimile machine (trade name: SFX 85, manufactured by Sanyo Electric co., Ltd.) and No. 3 Chart of The Imaging Society of Japan as a test chart. Thereafter, the state of adhesion of scum to thermal head was observed and evaluated according to the following criteria. The results are shown in Table 4.

[Criteria]

TABLE 4

| | Sensitivity | Background fogging | Image preservability (%) | Chemical resistance | Adaptability of inkjet printing | Adhesion of scum to head |
|---|---|---|---|---|---|---|
| Example 32 | 1.32 | 0.06 | 90 | A | A | B |
| Example 33 | 1.33 | 0.06 | 89 | A | A | B |
| Example 34 | 1.30 | 0.06 | 90 | A | A | B |
| Example 35 | 1.30 | 0.07 | 89 | A | A | B |
| Example 36 | 1.29 | 0.07 | 91 | A | A | B |
| Example 37 | 1.33 | 0.08 | 92 | A | A | B |
| Comparative Example 11 | 1.21 | 0.07 | 70 | C | C | B |
| Comparative Example 12 | 1.15 | 0.10 | 60 | A | C | B |
| Comparative Example 13 | 1.16 | 0.10 | 92 | A | A | B |
| Comparative Example 14 | 1.15 | 0.12 | 91 | A | A | B |
| Comparative Example 15 | 1.25 | 0.07 | 90 | A | A | D |

A: Adhesion of scum was not observed, and white spots and the like were not found on the prints.
B: An adhesion amount of scum was slight, and white spots and the like were not found on the prints.
C: An adhesion amount of scum was medium, and white spots and the like were not found on the prints.
D: An adhesion amount of scum was large, and defects such as white spots were found on the prints.

As shown in Table 4, the thermal recording materials obtained in Examples 32 to 37 of the invention were superior in sensitivity, background fogging, storage stability of color-developing image and chemical resistance and had adaptability to inkjet recording and adaptability to head scum. On the other hand, the thermal recording material obtained in Comparative Example 11 using bisphenol A as the electron-accepting compound was inferior in sensitivity, image preservability, chemical resistance and adaptability to inkjet recording; and the thermal recording material obtained in Comparative Example 12 using a suflfonamide compound different from the sulfonamide compound of the invention was inferior in adaptability to inkjet recording in addition to the sensitivity and image preservability. In addition, the thermosensitive material obtained in Comparative Example 13 using 2-anilino-3-methyl-6-(N-cyclohexyl-N-methyl) amino-fluorane as the electron-donating colorless dye and the thermal recording material obtained in Comparative Example 14 using 3-dimethylamino-6-methyl-7-(m-toluidino)-fluorane as the electron-donating colorless dye were inferior in sensitive and background fogging; and the thermal recording material obtained in Comparative Example 15 not using the pigment was inferior in adaptability to head scum.

According to the invention, even when recycled paper is used as the support, by using a specific color developer, it becomes possible to provide a thermal recording material that has a good balance of characteristics among sensitivity, background fogging and image preservability and is low in abrasion of thermal head and superior in resistance to inkjet inks.

Further, according to the invention, even when recycled paper is used as the support, by using a specific color developer, it becomes possible to provide a thermal recording material that has a good balance of characteristics among sensitivity, background fogging and image preservability and is superior in chemical resistance and adaptability to inkjet printing.

Moreover, according to the invention, by containing 4-hydroxybenzenesulfone anilide as the electron-accepting compound and at least one of light calcium carbonate of calcite type, amorphous silica and aluminum hydroxide as the inorganic pigment in the heat-sensitive color-developing layer, it becomes possible to provide a thermal recording material that is superior in sensitivity, background fogging, preservability of image portions and chemical resistance and also superior in thermal head matching characteristics (such as adhesion of scum to thermal head and abrasion properties of thermal head), as compared with the conventional thermal recording materials.

In addition, the invention is characterized in that the heat-sensitive color-developing layer contains 4-hydroxybenzenesulfone anilide as the electron-accepting compound and at least one selected from 2-anilino-3-methyl-6-di-n-butylaminofluorane, 2-anilino-3-methyl-6-di-n-amylaminofluorane, and 2-anilino-3-methyl-6-(N-ethyl-N-p-benzyl)aminofluorane as the electron-donating colorless dye and is formed by using a pigment dispersion having a pH of 7 to 10. Thus, it is possible to provide a thermal recording material that is high in color density, less in background fogging and superior in preservability of image portions and chemical resistance, and is provided with adaptability to head scum and adaptability to inkjet recording, as compared with the conventional thermal recording materials.

What is claimed is:

1. A thermal recording material comprising a support and a heat-sensitive color-developing layer disposed on the support, the heat-sensitive color-developing layer containing an electron-donating colorless dye and an electron-accepting compound, wherein the heat-sensitive color-developing layer contains 4-hydroxy-benzene-sulfone anilide as the electron-accepting compound, and the support contains waste paper pulp as a primary component thereof.

2. The thermal recording material of claim 1, wherein the heat-sensitive color-developing layer further contains a basic pigment.

3. The thermal recording material of claim 2, wherein the basic pigment is at least one selected from the group consisting of bur-shaped calcium carbonate, aluminum hydroxide, basic magnesium carbonate, and magnesium oxide.

4. The thermal recording material of claim 1, wherein the heat-sensitive color-developing layer contains at least one selected from 2-anilino-3-methyl-6-di-n-butylaminofluorane, 2-anilino-3-methyl-6-di-n-amylaminofluorane, and 2-anilino-3-methyl-6-(N-ethyl-N-p-benzyl)aminofluorane as the electron-donating colorless dye.

5. The thermal recording material of claim 4, wherein a surface of the support has a paper surface pH of 6 to 9.

* * * * *